United States Patent [19]

Noble

[11] Patent Number: 4,598,491

[45] Date of Patent: Jul. 8, 1986

[54] TOY CAP GUN

[75] Inventor: Sid Noble, Hong Kong, Hong Kong

[73] Assignee: Arco Industries, Ltd., Kowloon, Hong Kong

[21] Appl. No.: 717,970

[22] Filed: Mar. 29, 1985

[51] Int. Cl.[4] ..... F41C 3/06

[52] U.S. Cl. ..... 42/58; 42/54; 446/401

[58] Field of Search ..... 42/54, 55, 57, 58; 446/22, 23, 398, 400, 401, 473

[56] References Cited

U.S. PATENT DOCUMENTS

| | | | |
|---|---|---|---|
| 876,088 | 1/1908 | Pfeil | 446/401 |
| 1,356,559 | 10/1920 | Rice | 42/54 |
| 1,989,448 | 1/1935 | Hasselmann | 42/1 R |
| 2,226,144 | 12/1940 | Smith | 446/23 |
| 2,440,177 | 4/1948 | Laidig | 446/23 |
| 2,734,310 | 2/1956 | Christopher | 446/473 |
| 2,734,311 | 2/1956 | Christopher | 446/473 |
| 3,410,013 | 11/1968 | Miller et al. | 42/54 |
| 3,470,788 | 10/1969 | Virtanen | 89/155 |
| 3,740,885 | 6/1973 | Leaman | 42/58 |
| 4,059,917 | 11/1977 | Sims et al. | 446/398 |

FOREIGN PATENT DOCUMENTS

| | | | |
|---|---|---|---|
| 2151147 | 7/1985 | United Kingdom | 446/23 |

*Primary Examiner*—Deborah L. Kyle
*Assistant Examiner*—Ted L. Parr
*Attorney, Agent, or Firm*—Lilling & Greenspan

[57] ABSTRACT

A toy cap gun having a chamber which amplifies sound and illuminates the flash from detonated caps. The chamber is attached to the barrel and gun in one embodiment in a manner permitting its complete removal from the gun. A spindle means enshrouded by the chamber is used for holding and rotating the caps to be struck by the gun's hammer and the position of the spindle means inside the chamber produces a dramatic sound and light effect when the caps are detonated.

7 Claims, 6 Drawing Figures

TOY CAP GUN

BACKGROUND OF THE INVENTION

Cap guns have been popular toys for youngsters for decades of playing. Much to many parents' chagrin the louder the noise the more desirable the play gun. The traditional methods of making cap guns louder have been to utilize larger caps which release more detonation gases into the gun's chamber or to modify the chamber to internally focus the sound waves and gases to simulate an authentic gun sound.

Using larger caps in toy cap guns can create safety problems for young children and modifying the gun's structure can make the toy more expensive. It is thus an object of this invention to provide a toy cap gun which has a chamber which amplifies the sound waves produced by the detonated caps and at the same time is illuminated for a dramatic effect. The chamber makes the toy gun desirable for both parents and children since parents need not worry about their children's safety and children can enjoy a dramatically loud and illuminated toy.

SUMMARY OF THE INVENTION

The invention consists of a toy cap gun which may have any type of body design that is desired. The chamber of the gun enshrouds the cap spindle means so that the gases from the detonated caps pass through the chamber which amplifies the sound waves and illuminates the released flash. Thus, a toy cap gun is created which is simple in construction and has a unique chamber making the toy particularly appealing to children.

DETAILED DESCRIPTION OF THE INVENTION

Figure 1:
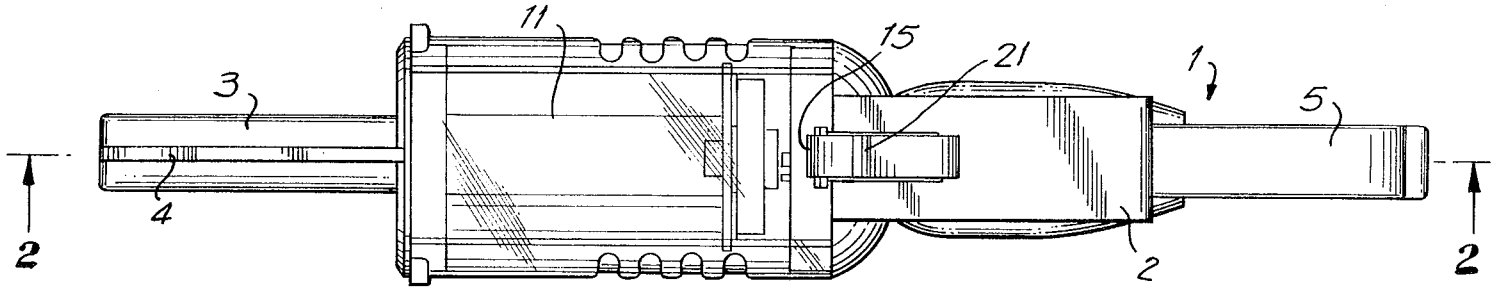
FIG. 1 is a top view of the toy cap gun.
Figure 2:
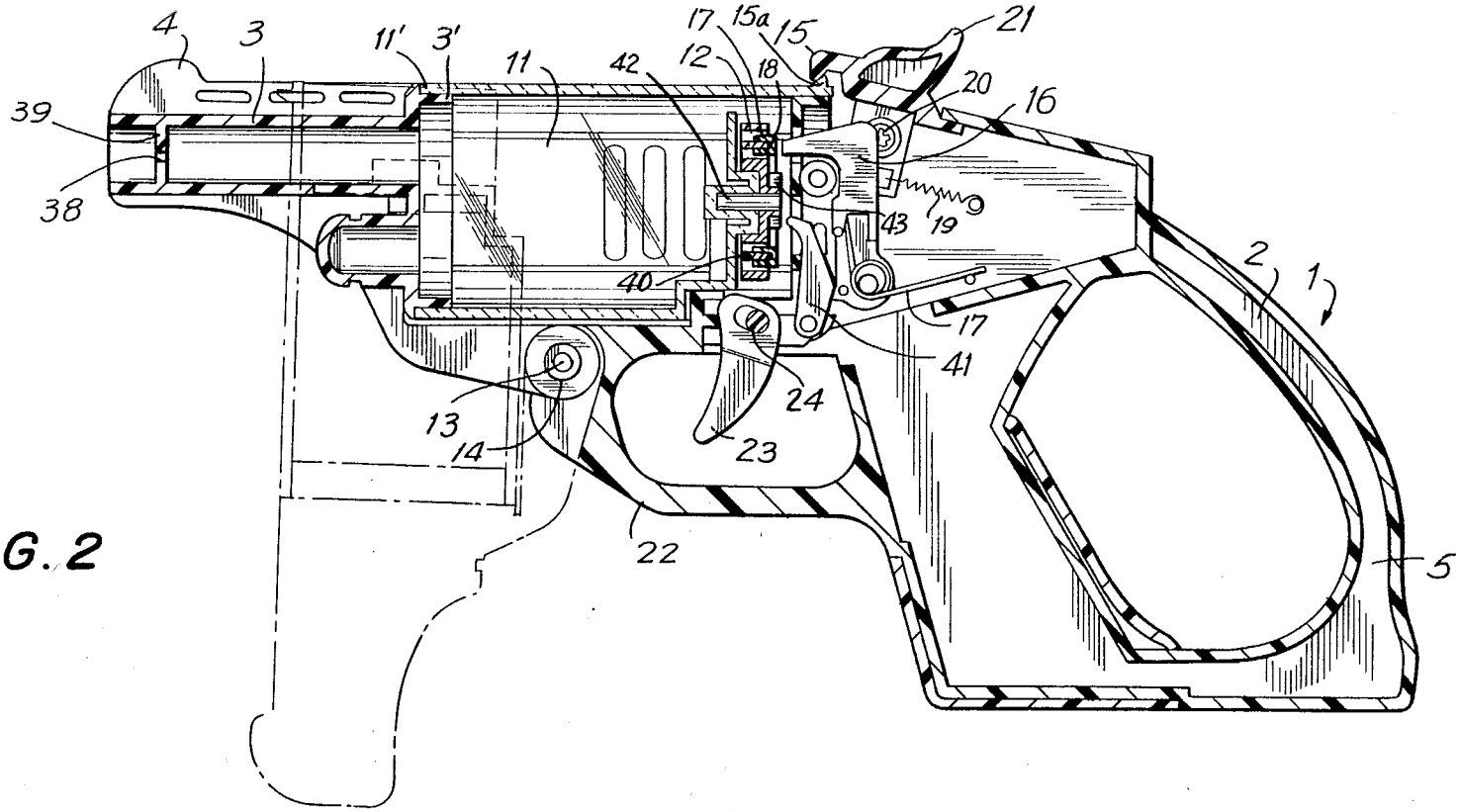
FIG. 2 is a cross sectional view taken along lines 2—2 of FIG. 1.
Figure 3:
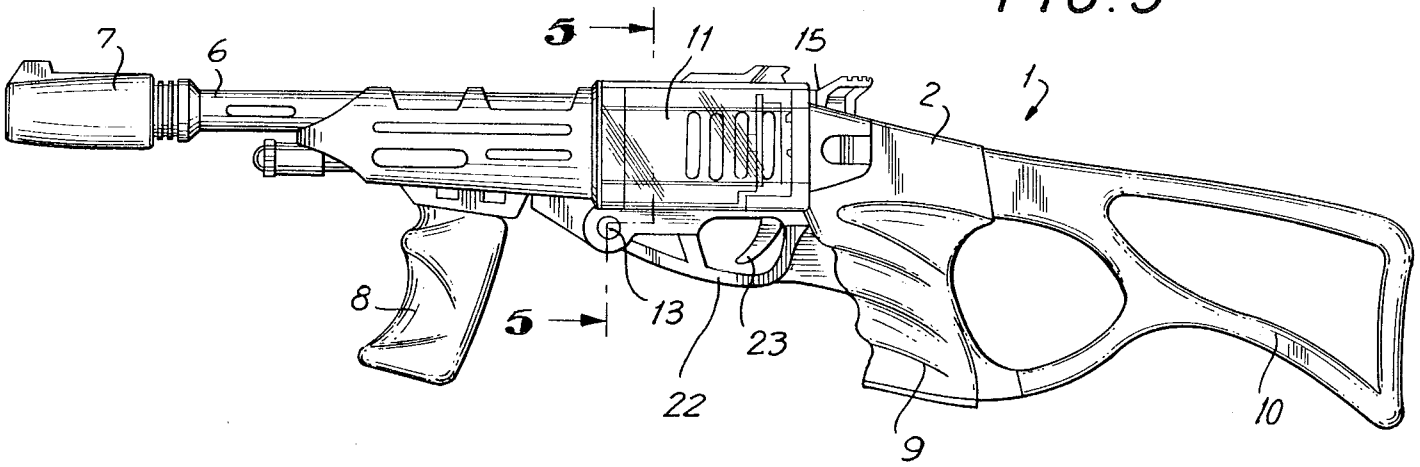
FIG. 3 is a side view of a toy cap rifle.

As shown in FIGS. 1, 2 and 3, the toy cap gun 1 may have a body 2 design of any desired type. In FIGS. 1 and 2 the toy cap gun is depicted as a pistol, while in FIG. 3 the toy is shown as a rifle. In FIG. 2, the handgun is depicted with a short barrel 3 having a front sight blade 4 and a short handle 5. The toy rifle, shown in FIG. 3, is pictured with an elongated barrel 6, a flash suppressor 7, a rifle grip 8, a pistol grip 9, and a stock 10. The gun's body 2 design can thus be of any chosen shape such as a pistol, an handgun, a rifle, a machine gun, or any other type of gun that is desired.

Further, any suitable material, such as metal or plastic, may be used to make the body 2 of the toy cap gun 1. The chamber 11 of the toy enshrouds a rotating cap anvil 12 and serves to illuminate the flash from the detonated caps and to amplify the sound waves released. Although any suitable material may be used to manufacture the gun's chamber 11 which facilitates the illumination and amplification purposes, in the preferred embodiment the chamber 11 is made of either transparent or translucent plastic materials.

The chamber 11 is connected to the barrel 3 by snuggly fitting the forward end 11' of the chamber 11 onto a circular boss 3' of the barrel 3 or by any means well known in the art.

Figure 6:
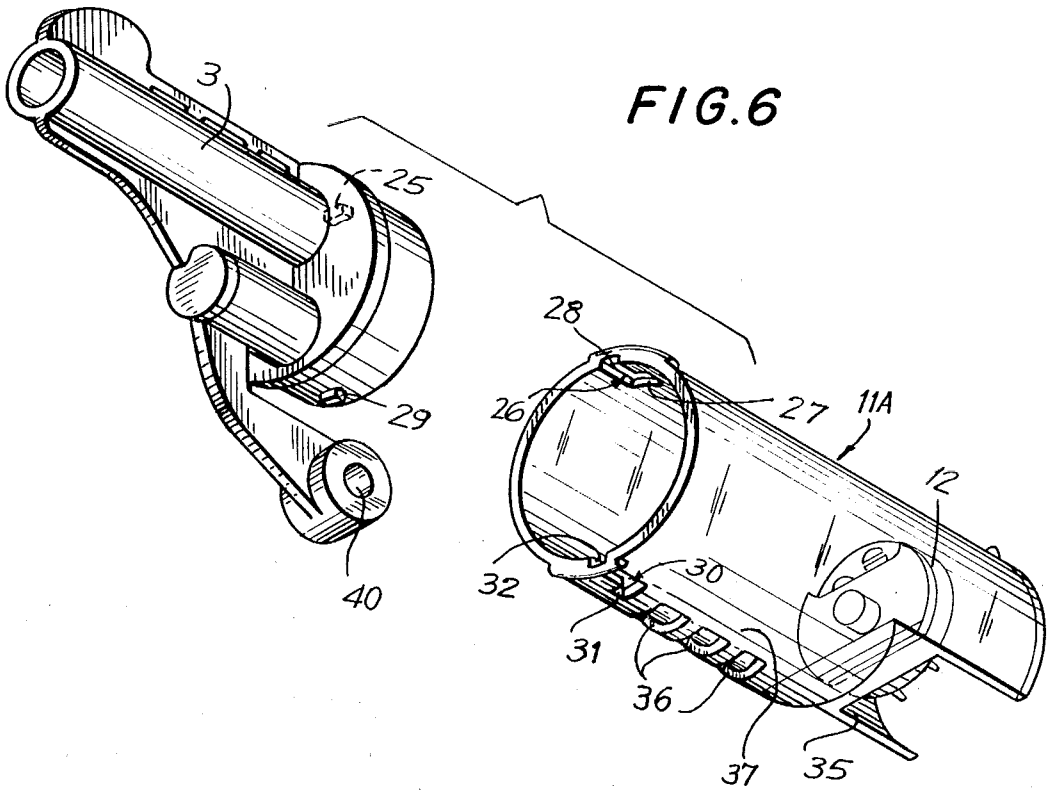
FIG. 6 is an exploded perspective view of the front barrel and removable chamber.

As shown in FIG. 6, a chamber 11A is preferably attached to the barrel 3 by a notch and groove opening arrangement. This fastening means operates by the simultaneous movement of a barrel top notch 25 in the chamber groove 26 and a bottom notch 29 in the the groove 30. The chamber 11A is removed from the gun by turning the chamber in a circular direction so that the top notch 25 located on the gun barrel moves from the smaller end 27 of the groove opening 26 to the larger end 28 of the groove opening 26 in chamber 11A and at the same time the bottom notch 29 of the gun barrel moves from the smaller end 31 of the groove opening 30 to the larger end 32 of the groove opening 30 in the chamber 11A. When the notches are moved into the larger ends 28, 32 of the grooves 26, 30, the barrel 3 and chamber 11A can be pulled apart and thus disengaged. To fasten the barrel 3 to the chamber 11A the above sequence of events is reversed.

A chamber pivot rod 13 extends through the trigger guard 22, thereby pivotally connecting the bottom side 37 of the chamber 11 to the gun's body 2 to enable the chamber 11 to be rotated to an open position, as shown in phantom lines on FIG. 2. The pivot rod 13 can be held in place with a screw, nail or any other conventional fastener 14 as shown. When the release 15 is pushed, the chamber 11 rotates around the pivot rod 13 to move into an open position.

In the preferred embodiment, the gun barrel 3, rather than the chamber 11A, is pivotally attached to the trigger guard 22 by means of a pivot rod through a rod opening 40 which is held in place by any conventional fastener known in the art. By attaching the barrel 3 to the gun 1 a child can completely remove the chamber 11A from the gun 1 for ease of cleaning away debris from detonated caps 18'. When the release 15 is pushed, it disengages from the release lip **15*a* and the chamber 11A swings into an open position and is removed from the gun 1** by uncoupling the notch and groove arrangement.

In manufacturing the chamber 11 of the gun 1 a realistic gun chamber may be simulated or an enlarged chamber may be made for dramatic effects and to increase the echoing area for sound waves produced when the caps 18 are detonated. A preferred embodiment of the chamber 11 is molded in a brighly colored plastic, such as red, which would illuminate easily when the detonated cap 18 flashes.

In another preferred embodiment, openings 36 are made in the chamber's bottom wall 37, as shown in FIG. 6, which allow detonation gases to escape quickly from the chamber 11A. With the addition of these openings 36, an opening 38 in a plug wall 39 of the barrel 3 may or may not be included in the manufacture of the gun 1, depending on the type of gun that is desired. A blindly plugged barrel end may be desirable to prevent cap debris from escaping from the chamber 11A and possibly harming an imprudent child who is exploring the consequences of shooting a cap gun 1 into his mouth.

In FIG. 6, the chamber 11A is shown with a cutout 35 on the bottom side 37 of the chamber 11A below the spindle anvil means 12. This cutout 35 on the bottom side is for ease of positioning the chamber 11A in the body 2 of the gun 1.

As shown in FIG. 2, it is possible to move the chamber 11 of the toy gun from a closed position in alignment with the hammer 16 and the barrel 3 to an open position. By pressing the release spur 21, the release 15 pivots around the release pivot rod 20 by means of the release spring 19 thus disengaging the release 15 from the lip 15*a* on the chamber 11 and allowing the chamber 11 to move into an open position. In an open position, a cap disc 17 can be mounted to the outside of the anvil means 12 to reload the gun and ready it for firing.

Figure 5:
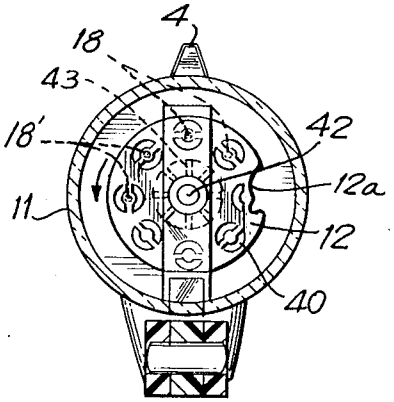
FIG. 5 is a cross sectional view taken along lines 5—5 of FIG. 3.
Figure 4:
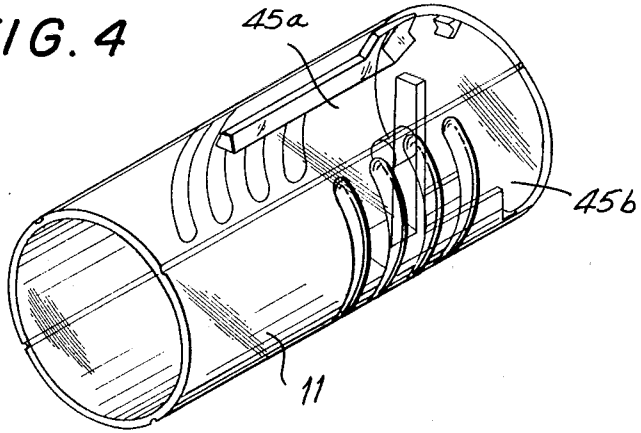
FIG. 4 is a perspective view of the removable chamber.

To assist the user in the loading and unloading of a cap disc 17, the anvil means 12 preferably has a cutaway area 12*a* near one of the cap supports 40, as shown in FIG. 5. A snuggly fitting cap disc 17 can be pinched by small fingers reaching through the cutaway 12*a*, which allows access to the underside of the disc 17 for firmly grasping it.

The rotating cap anvil means 12 is positioned inside the chamber 11 so that the chamber 11 enshrouds the anvil 12. When the caps are detonated by the gun's hammer 16 striking against the caps 18 within the disc 17 on the cap anvil 12, gases and sound waves are released from the detonation which fill the chamber 11.

The hammer 16 can either be manually pulled back by the operator and released, or mechanically operated by the trigger 23. When the trigger 23 is pulled into a shooting position, it rotates on the trigger pivot rod 24. Trigger actualization moves the hammer 16 rearwardly against the tension of the hammer spring 17 until the hammer is released to spring forward and strike a cap 18 in the cap disc 17, as is well known in the art.

At the same time that the trigger 23 is pulled in a shooting position the cap positioning pawl 41 is pushed upwardly to engage a ratchet 43 on the cap anvil 12 to turn the anvil 12 in a circular position for a predetermined distance to position the next cap 18 in firing position so that the hammer 16 will strike the positioned cap 18 when it is released back to its initial position. Thus, by the trigger means, the hammer is moved into a firing position at the same time that a cap 18 is positioned to be detonated. An expended cap 18' is moved out of position and a new cap 18 is moved into firing position each time the trigger 23 is pulled so that the anvil 12 circularly rotates around the axle 42. The cap to anvil 12 has a plurality of cap supports 40 around the circumference so that each cap is positioned on a support 40 for striking.

At the same time that the trigger 23 is pulled in a shooting position the cap positioning pawl 41 is pushed upwardly to engage a ratchet 43 on the cap anvil 12 to turn the anvil 12 in a circular position for a predetermined distance to position the next cap 18 in firing position so that the hammer 16 will strike the positioned cap 18 when it is released back to its initial position. Thus, by the trigger means, the hammer is moved into a firing position at the same time that a cap 18 is positioned to be detonated. An expended cap 18' is moved out of position and a new cap 18 is moved into firing position each time the trigger 23 is pulled so that the anvil 12 circularly rotates around the axle 42. The cap to anvil 12 has a plurality of cap supports 40 around the circumference so that each cap is positioned on a support 40 for striking.

I claim:

1. A toy cap gun comprising: a chamber illuminating and amplifying cap detonation such that the flash is visible through the material of the chamber wall; a gun barrel located on an outer end of the chamber; a rotating cap anvil means located on an inner end of the chamber and extending into and holding caps within said chamber; a hammer located adjacent to said cap anvil means and intermittently striking and detonating the caps; and trigger means located outside the chamber and mechanically connected to the hammer for intermittently impacting the hammer against the caps.

2. A toy cap gun according to claim 1, further comprising a release removably attached to said inner end of the chamber, and wherein said outer end of said chamber is pivotally attached to said gun to permit rotation of the chamber to an open position when said release is pushed.

3. A toy cap gun according to claim 2, wherein the chamber is secured to said gun barrel by means of a notch on said barrel which fits into a groove opening in said chamber and said barrel is pivotally attached to said gun to permit removal of said chamber from said gun.

4. A toy cap gun according to claim 3, wherein the anvil means comprises a cap support and a cutout on an outer edge of said anvil near said cap support to permit removal of a cap disc holding caps from said anvil means.

5. A toy cap gun according to claim 4, wherein a wall of said chamber includes an opening permitting gas of said detonated caps to escape from said chamber.

6. A toy cap gun according to claim 1, wherein the material of the chamber is translucent.

7. A toy cap gun according to claim 1, wherein the material of the chamber is transparent.

* * * * *